US006599137B2

(12) United States Patent
Modina

(10) Patent No.: US 6,599,137 B2
(45) Date of Patent: Jul. 29, 2003

(54) COMBINED EYELET TERMINAL CONNECTOR BRACKET AND WIRE HARNESS TROUGH ATTACHMENT TAB

(75) Inventor: Rene John A. Modina, Dearborn Heights, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/025,328

(22) Filed: Dec. 19, 2001

(65) Prior Publication Data

US 2002/0081876 A1 Jun. 27, 2002

Related U.S. Application Data

(60) Provisional application No. 60/257,469, filed on Dec. 21, 2000.

(51) Int. Cl.[7] ..... H01R 13/648

(52) U.S. Cl. ..... 439/92; 439/883; 439/459

(58) Field of Search ..... 439/889, 883, 439/459, 464, 470, 719, 92

(56) References Cited

U.S. PATENT DOCUMENTS

| | | | | |
|---|---|---|---|---|
| 1,044,923 A | | 11/1912 | Schoenmehl | |
| 1,847,689 A | | 3/1932 | Gribbie | |
| 1,970,635 A | | 8/1934 | Szekely | |
| 2,019,457 A | | 10/1935 | Lodge | |
| 2,228,138 A | | 1/1941 | Larkin, Jr. | |
| 4,357,070 A | | 11/1982 | Fukushima et al. | |
| 4,488,770 A | | 12/1984 | Lui et al. | |
| 4,538,875 A | * | 9/1985 | Krenz | 439/470 |
| 4,679,888 A | | 7/1987 | Williams | |
| 4,799,900 A | | 1/1989 | Capp et al. | |
| 4,832,629 A | | 5/1989 | Sasaki et al. | |
| 5,295,860 A | | 3/1994 | Jozefczyk et al. | |
| 5,759,055 A | | 6/1998 | Colantuano et al. | |
| 6,053,780 A | * | 4/2000 | Ono et al. | 439/810 |
| 6,126,493 A | | 10/2000 | Price et al. | |
| 6,280,263 B1 | * | 8/2001 | Manor et al. | 439/801 |

* cited by examiner

*Primary Examiner*—Tho D. Ta
(74) *Attorney, Agent, or Firm*—Bill C. Panagos

(57) ABSTRACT

A combined electrical ground terminal and wire harness trough attachment assembly for a vehicle. In one embodiment, the assembly includes a wire harness trough for routing a wire harness, the trough having a vehicle attachment tab, the tab having a tab hole and an anti-rotation slot formed therein. The assembly also includes a ground wire having an eyelet terminal including an anti-rotation tab. The eyelet terminal is adapted to align with the tab hole so that the ground wire and the attachment tab can be connected to a vehicle ground point by a connector, and the anti-rotation tab cooperates with the anti-rotation slot to minimize eyelet terminal rotation.

18 Claims, 3 Drawing Sheets

COMBINED EYELET TERMINAL CONNECTOR BRACKET AND WIRE HARNESS TROUGH ATTACHMENT TAB

CROSS-REFERENCE TO RELATED APPLICATIONS

This application claims the benefit of U.S. provisional application Ser. No. 60/257,469 filed Dec. 21, 2000.

TECHNICAL FIELD

The present invention relates generally to electrical ground terminals and wire harness troughs and, more particularly, to a combined eyelet connector bracket and trough attachment tab for use in an automotive engine compartment.

BACKGROUND ART

Modern automotive vehicles are equipped with a wide variety of electrical and electronic components. As is well known to those of ordinary skill, a number of wires and/or wire harnesses and ground points are required for such components. Such wires and/or wire harnesses are often routed through the engine compartment using troughs to protect and secure the wires and/or wire harnesses in place. Such troughs are often attached to the engine block, vehicle frame or a sheet metal member using a bolt, or a nut and stud assembly. As the number of wires and/or wire harnesses associated with modern vehicles increases, more ground points and wire trough attachment points are required, which tend to increase vehicle expense.

Thus, there exists a need for a combined electrical ground terminal and wire trough attachment assembly that eliminates the need for multiple ground points, or minimizes the number of ground points that must be provided in a vehicle engine compartment, thereby reducing process time during vehicle assembly and wiring. Such a combined ground terminal and trough attachment assembly would preferably incorporate an eyelet terminal of a ground wire in a bracket or trough attachment tab in a bolt driven or nut-plus-stud ground attachment. Such an assembly would also preferably include an anti-rotation feature to prevent or minimize rotation of the eyelet terminal.

SUMMARY OF THE INVENTION

Accordingly, it is an object of the present invention to provide a combined electrical ground terminal and wire harness trough attachment assembly for a vehicle that eliminates the need for multiple ground points, or minimizes the number of ground points that must be provided in a vehicle engine compartment, thereby reducing process time during vehicle assembly and wiring.

According to the present invention, a combined electrical ground terminal and wire harness trough attachment assembly for a vehicle is provided. The assembly comprises a wire harness trough for routing a wire harness, the trough having a vehicle attachment tab, the tab having a tab hole and an anti-rotation slot formed therein. The assembly further comprises a ground wire having an eyelet terminal including an anti-rotation tab. The eyelet terminal is adapted to align with the tab hole so that the ground wire and the attachment tab can be connected to a vehicle ground point by a connector, and the anti-rotation tab cooperates with the anti-rotation slot to minimize eyelet terminal rotation.

According to another embodiment of the present invention, a combined electrical ground terminal and wire harness trough attachment assembly for a vehicle is provided. In this embodiment, the assembly comprises a wire harness trough for routing a wire harness, the trough having a vehicle attachment tab, the tab having a tab hole formed therein and an anti-rotation tab. The assembly further comprises a ground wire having an eyelet terminal including an anti-rotation slot formed therein. The eyelet terminal is adapted to align with the tab hole so that the ground wire and the attachment tab can be connected to a vehicle ground point by a connector, and the anti-rotation tab cooperates with the anti-rotation slot to minimize eyelet terminal rotation.

According to yet another embodiment of the present invention, a combined electrical ground terminal and wire trough attachment assembly for a vehicle. In this embodiment, the assembly comprises a wire trough for use in routing a wire, and a vehicle attachment tab attached to the wire trough, the tab having a tab hole and an anti-rotation slot formed therein. The tab hole is adapted to align with an eyelet terminal of a ground wire so that the ground wire and the attachment tab can be connected to a vehicle ground point by a connector, and the anti-rotation slot is adapted to cooperate with an anti-rotation tab on the eyelet terminal of the ground wire to minimize eyelet terminal rotation.

According to still another embodiment of the present invention, a combined electrical ground terminal and wire trough attachment assembly for a vehicle is provided. In this embodiment, the assembly comprises a wire trough for use in routing a wire, and a vehicle attachment tab attached to the wire trough, the tab having a tab hole formed therein and an anti-rotation tab. The tab hole is adapted to align with an eyelet terminal of a ground wire so that the ground wire and the attachment tab can be connected to a vehicle ground point by a connector, and the anti-rotation tab is adapted to cooperate with an anti-rotation slot formed in the eyelet terminal of the ground wire to minimize eyelet terminal rotation.

These and other objects, features and advantages of the present invention will be readily apparent upon consideration of the following detailed description of the invention in conjunction with the accompanying drawings.

BEST MODE FOR CARRYING OUT THE INVENTION

Referring to FIGS. 1-9, the preferred embodiment of the present invention will now be described. As previously noted, modern automotive vehicles are equipped with a wide variety of electrical and electronic components. As is well known to those of ordinary skill, a number of wires and/or wire harnesses and ground points are required for such components. Such wires and/or wire harnesses are often routed through the engine compartment using troughs to protect and secure the wires and/or wire harnesses in place. Such troughs are often attached to the engine block, vehicle frame or a sheet metal member using a bolt, or a nut and stud assembly. As the number of wires and/or wire harnesses associated with modern vehicles increases, more ground points and trough attachment points are required, which tend to increase vehicle expense.

Thus, as also noted above, there exists a need for a combined electrical ground terminal and wire trough attachment assembly that eliminates the need for multiple ground points, or minimizes the number of ground points that must be provided in a vehicle engine compartment, thereby reducing process time during vehicle assembly and wiring. Such a combined ground terminal and trough attachment assembly would preferably incorporate an eyelet terminal of a ground wire in a bracket or trough attachment tab in a bolt driven or nut-plus-stud ground attachment. Such an assembly would also preferably include an anti-rotation feature to prevent or minimize rotation of the eyelet terminal.

Figure 1:
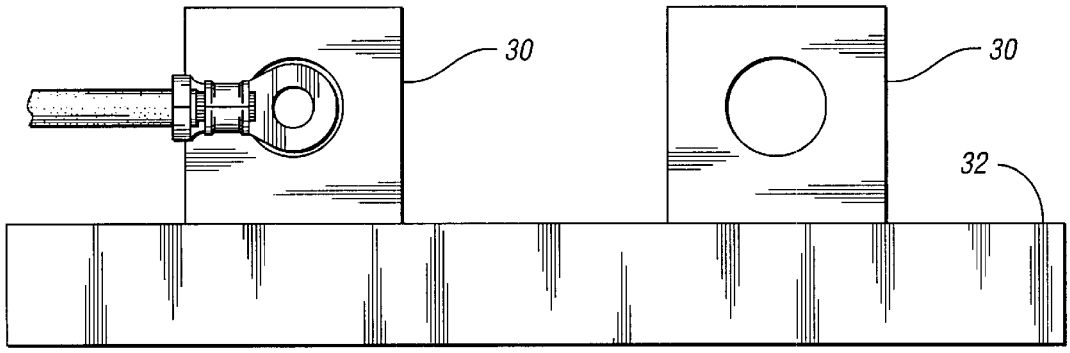
FIG. 1 is top view of the combined eyelet connector bracket and wire harness trough attachment assembly of the present invention showing a pair of vehicle attachment tabs.

Referring to FIG. 1, a top view of the combined eyelet connector bracket and wire harness trough attachment assembly of the present invention is shown, depicting a pair of vehicle attachment tabs (30) extending from a wire harness trough (32). As previously described, trough (32) is used for routing a wire harness in the vehicle engine compartment. Tabs (30) are used to attach trough (32) to the vehicle within the engine compartment. Vehicle attachment tabs (30) in FIG. 1 are shown in a simplified, general fashion, and may be provided with any of the specific designs described in detail below in connection with FIGS. 2–6.

At least one tab (30) is connected to a ground point on the vehicle, such as the vehicle engine block, frame or a sheet metal member (not shown) in any conventional fashion, such as by a bolt or a nut-plus-stud assembly (not shown). While two tabs (30) are shown extending from trough (32) in FIG. 7, it should be noted that any number of tabs (30) may be provided extending from trough (32) and used as combined ground terminal and trough attachment points.

Figure 2:
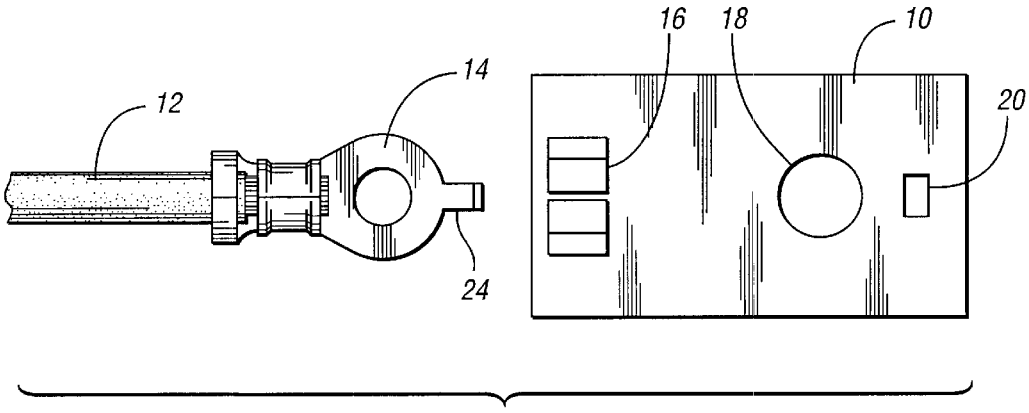
FIG. 2 is a top view of the combined eyelet connector bracket and wire harness trough attachment assembly of the present invention in an unassembled configuration.

Referring next to FIG. 2, a top view of the ground wire and vehicle attachment tab for use in the combined eyelet connector bracket and wire harness trough attachment assembly of the present invention is shown, in an unassembled configuration. As seen therein, a bracket (10) is adapted to receive a ground wire (12) having an eyelet terminal (14). Bracket (10) includes a wire holder (16), and has a tab hole (18) and an anti-rotation slot (20) formed therein. Additionally, eyelet terminal (14) has provided thereon an anti-rotation tab (24).

Figure 3:
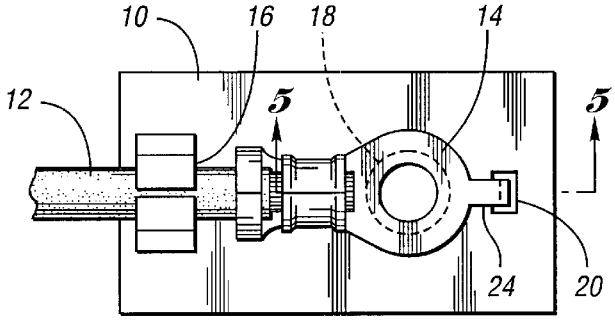
FIG. 3 is a top view of the combined eyelet connector bracket and wire harness trough attachment assembly of the present invention in a partially assembled configuration.

Referring to FIG. 3, a top view of the ground wire and vehicle attachment tab for use in the combined eyelet connector bracket and wire harness trough attachment assembly of the present invention is shown, in a partially assembled configuration. As seen therein, eyelet terminal (14) of ground wire (12) aligns with tab hole (18) of bracket (10). Eyelet terminal (14) and tab hole (18) being aligned in such a fashion allows for the insertion of a bolt or stud (not shown) through both in order to secure ground wire (12) to bracket (10), as well as to a particular ground point on the vehicle, such as the engine block, vehicle frame or a sheet metal member.

As also seen in FIG. 3, anti-rotation tab (24) of eyelet terminal (14) fits into anti-rotation slot (20) of bracket (10). Anti-rotation tab (24) and anti-rotation slot (20) cooperating in such a fashion provides for repeatability during assembly by preventing or minimizing rotation of eyelet terminal (14), particularly when the previously mentioned bolt (not shown) inserted through eyelet terminal (14) and tab hole (18) is tightened, or when a nut (not shown) is tightened on the previously mentioned stud (not shown) inserted through eyelet terminal (14) and tab hole (18).

As also seen in FIG. 3, wire holder (16) on bracket (10) acts to hold ground wire (12) in place. Wire holder (16) thereby also provides for repeatability during assembly by preventing or minimizing rotation of eyelet terminal (14), particularly when the previously mentioned bolt (not shown) inserted through eyelet terminal (14) and tab hole (18) is tightened, or when a nut (not shown) is tightened on the previously mentioned stud (not shown) inserted through eyelet terminal (14) and tab hole (18).

Figure 4:
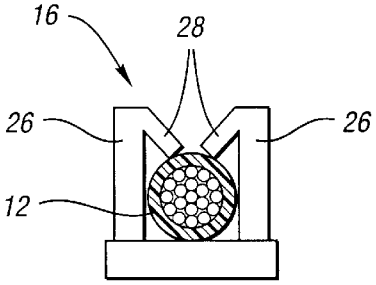
FIG. 4 is a side view of a wire holder for use in the combined eyelet connector bracket and wire harness trough attachment assembly of the present invention.

A side view of wire holder (16) is shown in FIG. 4. As seen therein, wire holder (16) includes a pair of opposed sidewalls (26), each having an inwardly disposed retention flange (28). Ground wire (12) is inserted in a generally downward direction between retention flanges (28) which, with sidewalls (26), elastically deform to accept ground wire (12). Retention flanges (28) then act to hold ground wire (12) between sidewalls (26) of wire holder (16). As is readily apparent to those of ordinary skill, wire holder (16) may be provided with any number of other designs suitable for holding ground wire (12) in place.

Figure 5:
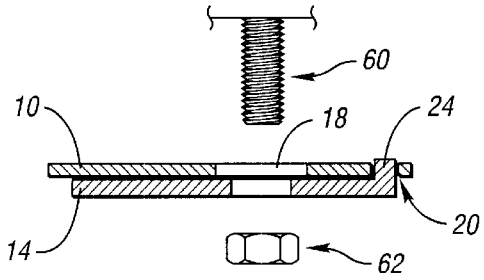
FIG. 5 is a cross-sectional view of the combined eyelet connector bracket and wire harness trough attachment assembly of the present invention taken along line 4-4 of FIG. 3.

FIG. 5 is a cross-sectional view of the combined eyelet connector bracket and wire harness trough attachment assembly of the present invention taken along line 5—5 of FIG. 3. As seen in FIG. 5, and as previously described in connection with FIG. 3, eyelet terminal (14) of ground wire (12) aligns with tab hole (18) of bracket (10) to allow insertion of a bolt, or a stud for use with a nut (60,62). As also described above in connection with FIG. 3, anti-rotation tab (24) of eyelet terminal (14) fits into anti-rotation slot (20) of bracket (10). As can be seen in FIG. 5, anti-rotation tab (24) is provided with a generally "L" shaped cross-section. However, anti-rotation tab (24) may be provided with a generally "J" shaped cross-section in order to improve contact with anti-rotation slot (20) of bracket (10).

Figure 6:
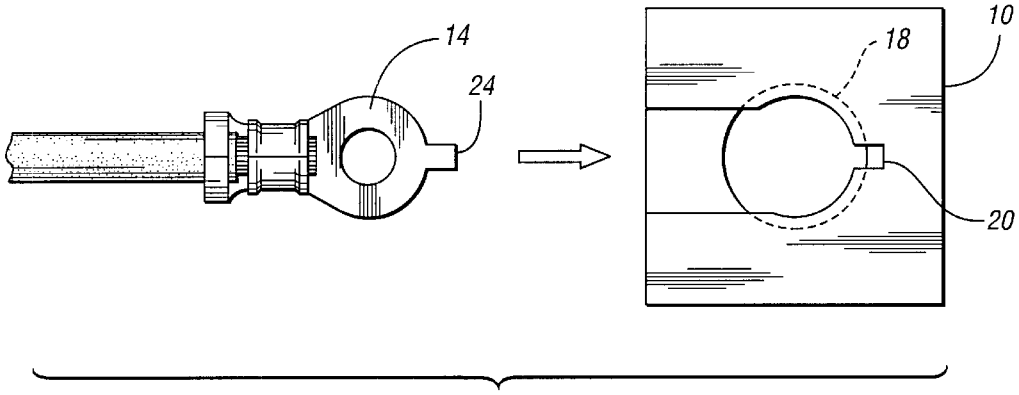
FIG. 6 is a top view of an alternative embodiment of the combined eyelet connector bracket and wire harness trough attachment assembly of the present invention.
Figure 7:
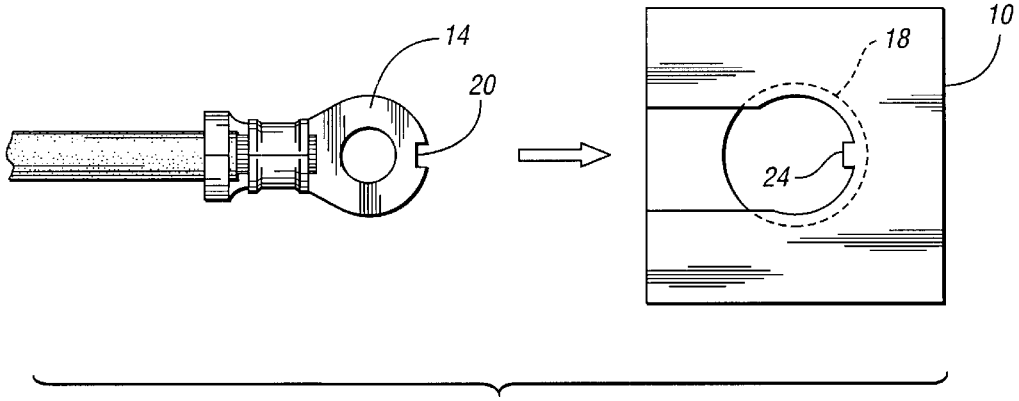
FIG. 7 is a top view of another alternative embodiment of the combined eyelet connector bracket and wire harness trough attachment assembly of the present invention.

Referring next to FIGS. 6 and 7, top views of alternative embodiments of the combined eyelet connector bracket and wire harness trough attachment assembly of the present invention are shown. As seen in FIGS. 6 and 7, eyelet terminal (14) can be oriented with bracket (10) such that tab hole (18) of bracket (10) aligns with eyelet terminal (14), thereby allowing for insertion of a bolt or stud (not shown) as previously described. As seen in FIG. 6, bracket (10) is provided with an anti-rotation slot (20) therein for receiving anti-rotation tab (24) of eyelet terminal (14). As seen in FIG. 7, eyelet terminal (14) is provided with an anti-rotation slot (20) therein for receiving anti-rotation tab (24) of bracket (10).

Figure 8:
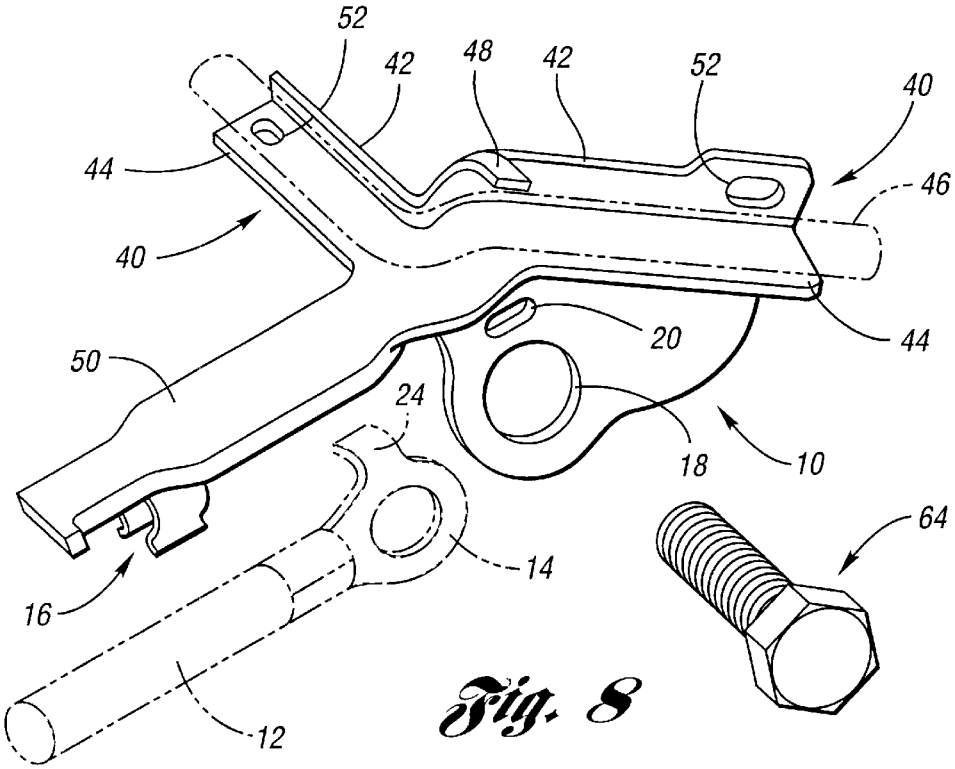
FIG. 8 is a perspective view of another alternative embodiment of the combined eyelet connector bracket and wire harness trough attachment assembly of the present invention.
Figure 9:
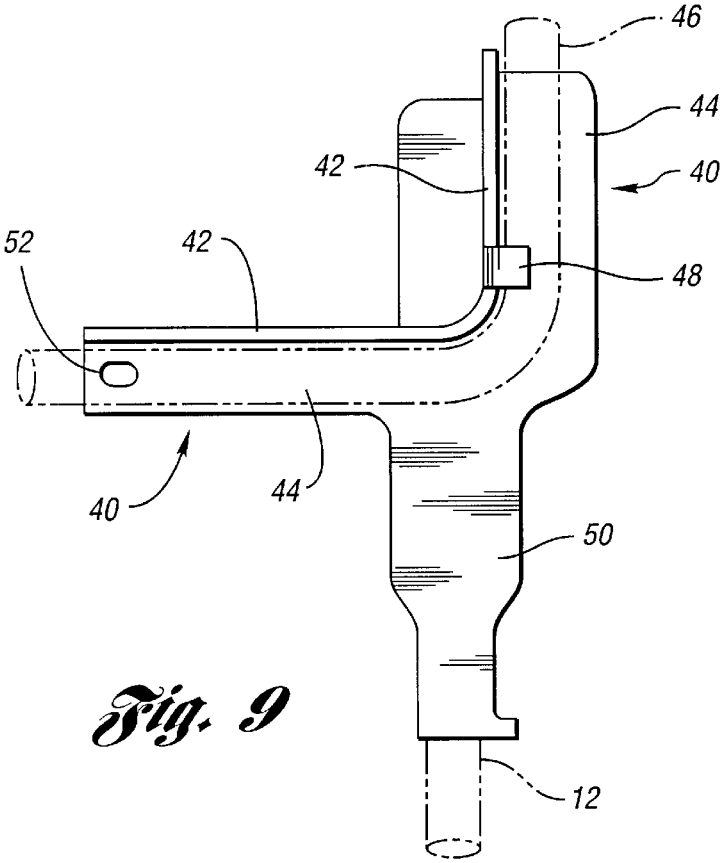
FIG. 9 is a perspective view of another alternative embodiment of the combined eyelet connector bracket and wire harness trough attachment assembly of the present invention.

Referring next to FIGS. 8 and 9, perspective views of another embodiment of the combined eyelet connector bracket and wire harness trough attachment assembly of the present invention are shown. As seen in FIG. 8, a bracket (10) is adapted to receive a ground wire (12) having an eyelet terminal (14). Bracket (10) includes a wire holder (16), such as a resilient "C" clamp, and has a tab hole (18) and an anti-rotation slot (20) formed therein. Additionally, eyelet terminal (14) has provided thereon an anti-rotation tab (24).

Eyelet terminal (14) of ground wire (12) is adapted to align with tab hole (18) of bracket (10). Eyelet terminal (14) and tab hole (18) being aligned in such a fashion allows for the insertion of a bolt or stud (not shown) through both in order to secure ground wire (12) to bracket (10), as well as to a particular ground point on the vehicle, such as the engine block, vehicle frame or a sheet metal member. As also seen in FIG. 8, anti-rotation tab (24) of eyelet terminal (14) fits into anti-rotation slot (20) of bracket (10). Anti-rotation tab (24) and anti-rotation slot (20) cooperating in such a fashion provides for repeatability during assembly by preventing or minimizing rotation of eyelet terminal (14), particularly when the previously mentioned bolt (64) inserted through eyelet terminal (14) and tab hole (18) is tightened, or when a nut (not shown) is tightened on the previously mentioned stud (not shown) inserted through eyelet terminal (14) and tab hole (18).

Wire holder (16) on bracket (10) acts to hold ground wire (12) in place. Wire holder (16) thereby also provides for repeatability during assembly by preventing or minimizing rotation of eyelet terminal (14), particularly when the previously mentioned bolt (64) inserted through eyelet terminal (14) and tab hole (18) is tightened, or when a nut (not shown) is tightened on the previously mentioned stud (not shown) inserted through eyelet terminal (14) and tab hole (18).

FIGS. 8 and 9 also more particularly show a wire or wire harness trough (40). Trough (40) is adapted to receive and support a wire or wire harness (46), such as for routing in an engine compartment (not shown). Trough (40) is formed, at least in part, by side walls (42) and base (44). In that regard, side walls (42) may be provided with a retention flange (48) for use in retaining wire or wire harness (46) in trough (40).

As seen in FIGS. 8 and 9, side wall (42) and base (44) may also be provided. with holes (52) for use in further securing the combined eyelet connector bracket and wire harness trough attachment assembly of the present invention in the engine compartment, such as to the vehicle engine block, frame or a sheet metal member (not shown) in any conventional fashion, such as by a bolt (64) or a nut-plus-stud assembly (not shown). As also seen in FIGS. 8 and 9, wire holder (16) may be spaced from tab hole (18) of bracket (10) and provided on a support arm (50) extending from bracket (IC).

From the foregoing description, it can be seen that the present invention provides a combined electrical ground terminal and wire harness trough attachment assembly that eliminates the need for multiple ground points, or minimizes the number of ground points that must be provided in a vehicle engine compartment, thereby reducing process time during vehicle assembly and wiring. More particularly, as described in detail above, the combined ground terminal and trough attachment assembly preferably incorporates an eyelet terminal of a ground wire in a bracket or trough attachment tab in a bolt driven or nut-plus-stud ground attachment. The assembly also preferably includes an anti-rotation feature to prevent or minimize rotation of the eyelet terminal.

While various embodiments of the invention have been illustrated and described, it is not intended that these embodiments illustrate and describe all possible forms of the present invention. Rather, the words used in the specification are words of description rather than limitation, and it is understood that various changes may be made without departing from the spirit and scope of the invention. Indeed, many alternatives, modifications, and variations will be apparent to those skilled in the art in light of the foregoing description, and the present invention is intended to embrace all such alternatives.

What is claimed is:

1. A combined electrical ground terminal and wire harness trough attachment assembly for a vehicle, the assembly comprising:

a wire harness trough for routing a wire harness, the trough having a vehicle attachment tab, the tab having a tab hole and an anti-rotation slot formed therein; and a ground wire having an eyelet terminal including an anti-rotation tab;

wherein the eyelet terminal is adapted to align with the tab hole so that the ground wire and the attachment tab can be connected to a vehicle ground point by a connector, and wherein the anti-rotation tab cooperates with the anti-rotation slot to minimize eyelet terminal rotation.

2. The electrical ground terminal and wire harness trough attachment assembly of claim 1 wherein the vehicle attachment tab includes a wire holder for holding the ground wire.

3. The electrical ground terminal and wire harness trough attachment assembly of claim 2 wherein the connector comprises a bolt.

4. The electrical ground terminal and wire harness trough attachment assembly of claim 2 wherein the connector comprises a nut and stud.

5. A combine d electrical ground terminal and wire harness trough attachment assembly for a vehicle, the assembly comprising:

a wire harness trough for routing a wire harness, the trough having a vehicle attachment tab, the tab having a tab hole formed therein and an anti-rotation tab; and a ground wire having an eyelet terminal including an anti-rotation slot formed therein;

wherein the eyelet terminal is adapted to align with the tab hole so that the ground wire and the attachment tab can be connected to a vehicle ground point by a connector, and wherein the anti-rotation tab cooperates with the anti-rotation slot to minimize eyelet terminal rotation.

6. The electrical ground terminal and wire harness trough attachment assembly of claim 5 wherein the vehicle attachment tab includes a wire holder for holding the ground wire.

7. The electrical ground terminal and wire harness trough attachment assembly of claim 6 wherein the connector comprises a bolt.

8. The electrical ground terminal and wire harness trough attachment assembly of claim 6 wherein the connector comprises a nut and stud.

9. A combined electrical ground terminal and wire trough attachment assembly for a vehicle, the assembly comprising:

a wire trough for use in routing a wire; and a vehicle attachment tab attached to the wire trough, the tab having a tab hole and an anti-rotation slot formed therein;

wherein the tab hole is adapted to align with an eyelet terminal of a ground wire so that the ground wire and the attachment tab can be connected to a vehicle ground point by a connector, and wherein the anti-rotation slot is adapted to cooperate with an anti-rotation tab on the eyelet terminal of the ground wire to minimize eyelet terminal rotation.

10. The assembly of claim 9 further comprising a wire holder for use in holding the ground wire.

11. The assembly of claim 9 wherein the connector comprises a bolt.

12. The assembly of claim 9 wherein the connector comprises a nut and stud.

13. The assembly of claim 9 wherein the wire comprises a wire harness.

14. A combined electrical ground terminal and wire trough attachment assembly for a vehicle, the assembly comprising:

a wire trough for use in routing a wire; and a vehicle attachment tab attached to the wire trough, the tab having a tab hole formed therein and an anti-rotation tab;

wherein the tab hole is adapted to align with an eyelet terminal of a ground wire so that the ground wire and the attachment tab can be connected to a vehicle ground point by a connector, and wherein the anti-rotation tab is adapted to cooperate with an anti-rotation slot formed in the eyelet terminal of the ground wire to minimize eyelet terminal rotation.

15. The assembly of claim 14 further comprising a wire holder for use in holding the ground wire.

16. The assembly of claim 14 wherein the connector comprises a bolt.

17. The assembly of claim 14 wherein the connector comprises a nut and stud.

18. The assembly of claim 14 wherein the wire comprises a wire harness.

* * * * *